US009485595B2

(12) United States Patent
Trine et al.

(10) Patent No.: US 9,485,595 B2
(45) Date of Patent: Nov. 1, 2016

(54) INVERTED FLANGE EARBUD

(71) Applicant: Starkey Laboratories, Inc., Eden Prairie, MN (US)

(72) Inventors: Timothy Daniel Trine, Eden Prairie, MN (US); Sidney A. Higgins, Maple Grove, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/467,353

(22) Filed: Aug. 25, 2014

(65) Prior Publication Data

US 2016/0057528 A1 Feb. 25, 2016

(51) Int. Cl.
*H04R 25/00* (2006.01)
*H04R 1/10* (2006.01)

(52) U.S. Cl.
CPC ..... *H04R 25/654* (2013.01); *H04R 25/652* (2013.01); *H04R 1/1016* (2013.01); *H04R 1/1091* (2013.01); *H04R 25/60* (2013.01); *H04R 25/65* (2013.01); *H04R 25/656* (2013.01); *H04R 2460/09* (2013.01); *H04R 2460/11* (2013.01)

(58) Field of Classification Search
CPC .... H04R 1/10; H04R 1/1008; H04R 1/1016; H04R 1/105; H04R 1/1058; H04R 1/1066; H04R 1/1075; H04R 5/033; H04R 5/027; H04R 5/0335; H04R 2205/024; H04R 2201/103; H04R 2205/022; H04R 2420/07; H04R 25/60; H04R 25/65; H04R 25/652; H04R 25/656; H04R 25/658; H04R 1/1091; H04R 25/654; H04R 2460/09; H04R 2460/11
USPC ..... 381/380, 328, 358, 367, 370, 371, 374, 381/375; 181/129, 130, 133, 135, 136; 264/295
See application file for complete search history.

(56) References Cited

U.S. PATENT DOCUMENTS

| | | | | |
|---|---|---|---|---|
| 2,803,308 | A * | 8/1957 | Di Mattia | A61B 7/02 181/135 |
| 4,457,396 | A * | 7/1984 | James | H04R 1/345 181/129 |
| 5,242,767 | A * | 9/1993 | Roback | H01M 2/1022 320/114 |
| 5,781,638 | A | 7/1998 | Hosaka et al. | |
| 6,000,492 | A * | 12/1999 | Puthuff | H04R 25/654 181/135 |
| 7,010,137 | B1 | 3/2006 | Leedom et al. | |
| 8,061,472 | B2 | 11/2011 | Tiemens | |
| 2006/0280325 | A1 | 12/2006 | Lin et al. | |
| 2007/0221232 | A1 * | 9/2007 | Jenkins | A61F 11/08 128/864 |
| 2009/0052711 | A1 | 2/2009 | Murozaki | |
| 2009/0101433 | A1 * | 4/2009 | Stiehl | B29C 45/0025 181/129 |
| 2010/0300461 | A1 | 12/2010 | Gilder et al. | |
| 2016/0057551 | A1 | 2/2016 | Higgins et al. | |

OTHER PUBLICATIONS

"U.S. Appl. No. 14/467,392, Non Final Office Action mailed Dec. 17, 2015", 18 pgs.
"U.S. Appl. No. 14/467,392, Response filed Apr. 18, 2016 to Non Final Office Action mailed Dec. 17, 2015", 13 pgs.
"European Application Serial No. 15182269.9, Extended European Search Report mailed Jan. 12, 2016", 8 pgs.

* cited by examiner

*Primary Examiner* — Davetta W Goins
*Assistant Examiner* — Oyesola C Ojo
(74) *Attorney, Agent, or Firm* — Schwegman Lundberg & Woessner, P.A.

(57) ABSTRACT

An earbud for use in conjunction with receiver-in-canal and similar hearing aids is described. A wax reservoir and a torturous path for wax ingress are provided by the earbud. A controlled acoustic path is also provided. The molded design of the earbud allows torturous paths for wax ingress to be designed into the earbud.

18 Claims, 3 Drawing Sheets

INVERTED FLANGE EARBUD

FIELD OF THE INVENTION

This invention pertains to electronic hearing aids and methods for their construction.

BACKGROUND

Hearing aids are electroacoustic device which amplify sound for the wearer in order to correct hearing deficits as measured by audiometry, usually with the primary purpose of making speech more intelligible. Certain types of hearing aids utilize an earbud that is placed in the wearer's external ear canal that conducts the sound produced by the hearing aid's receiver (i.e., loudspeaker). A receiver-in-canal (RIC) hearing aid has a small body that sits behind the ear and houses the hearing aid's microphone and audio processing circuitry. The receiver of the RIC hearing aid is attached to the earbud inside the ear and is connected to the body of the hearing aid by a cable or slim tube that houses the receiver wiring. A problem with RIC hearing aids is wax build-up inside the ears that can get into and permanently damage the receiver.

DETAILED DESCRIPTION

Most previous wax solutions for RIC hearing aids involve a small feature molded into the earbud or a secondary device placed underneath the earbud itself. The problem with the molded feature is that with customary design methods, the protrusion picks up cerium during insertion and removal as it scrapes along the external ear canal wall. The issue with the secondary device is that when clogged, it is seldom replaced. Described herein is an earbud, made of silicone or other material, that does not solely rely on a secondary device to prevent wax and debris from entering the receiver housing.

Figure 1A:
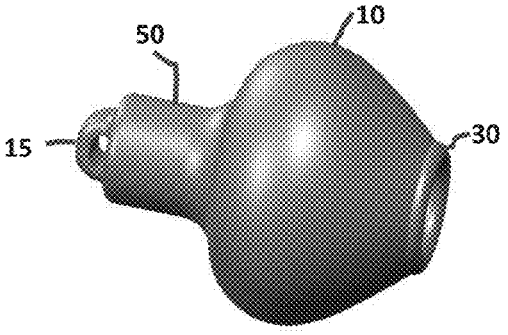
FIGS. 1A-1E illustrate an earbud according to one embodiment.
Figure 1B:
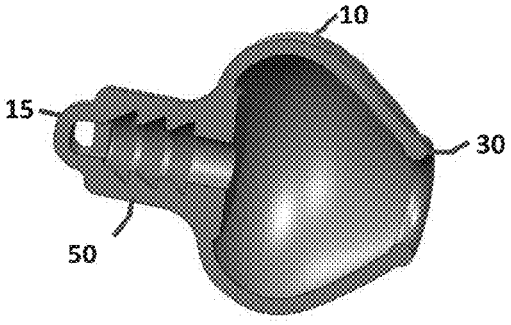
Figure 1C:
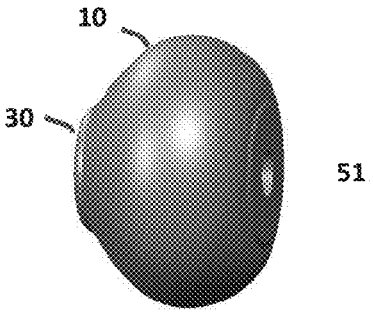
Figure 1D:
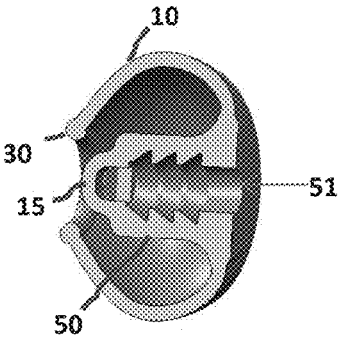
Figure 1E:
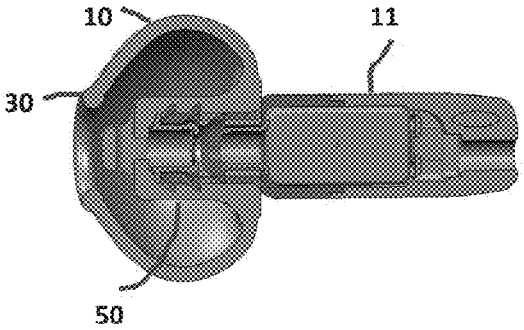
Figure 2A:
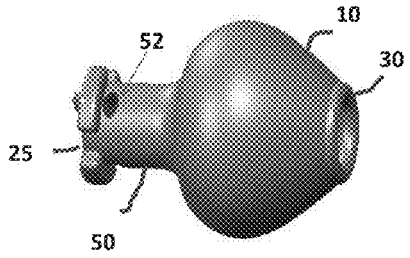
FIGS. 2A-2F illustrate an earbud according to one embodiment.
Figure 2B:
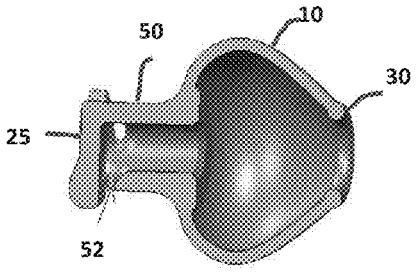
Figure 2C:
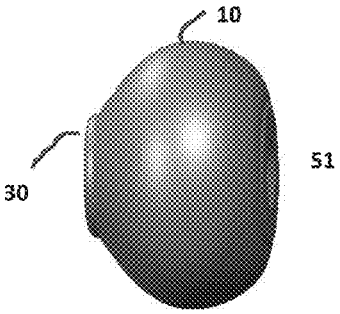
Figure 2D:
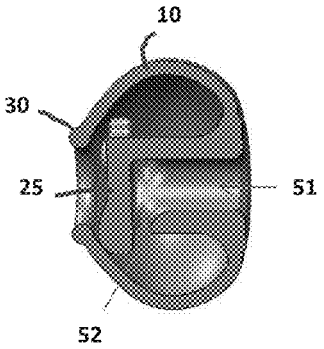
Figure 2F:
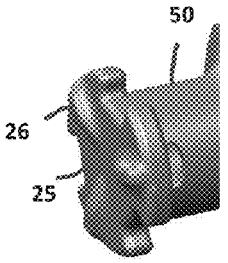
Figure 2E:
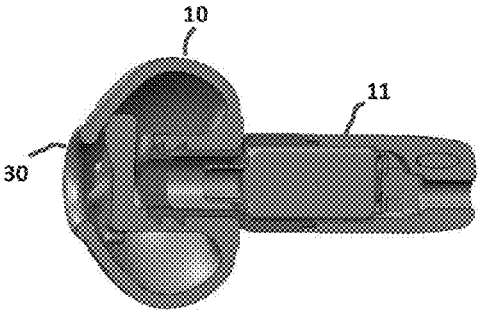

FIGS. 1A-1D and FIGS. 2A-2F each illustrate an example embodiment of an inverted flange earbud. Each of the embodiments is an earbud that includes a cylindrically shaped body 50 having proximal and distal ends, where the proximal end is inserted into the external ear canal. The body 50 has a cavity 51 located at its distal end for receiving and connecting to a hearing aid's receiver. One or more acoustic ports are located at the proximal end of the body and continuous with the cavity 51 for conducting sound produced by the hearing aid receiver into the external ear canal. A flange 10 made of resilient material extends radially and longitudinally from the circumference of a portion of the body and terminates in a relatively more rigid retainer ring 30. In the illustrated embodiments, the flange 10 extends from the circumference at the distal end of the body. The circumference of the flange 10 increases with longitudinal distance from the distal end of the body up to a maximum value and then decreases to the circumference of the retainer ring. The flange 10 is adapted to be inverted so that the retaining ring 30 is located proximally from the proximal end of the body to form a debris reservoir between the flange and the body for collecting wax as the earbud is inserted into the external ear canal. The circumference of the retainer ring 30 may be made smaller than the circumference of the body but stretchable to allow the flange 10 to be inverted over the body 50. FIGS. 1E and 2F illustrate the earbud with a receiver 11 inserted into the cavity 51.

In the embodiment shown by FIGS. 1A-1E, the earbud further comprises a deflector tip at the proximal end of the body having two radially directed acoustic ports for conducting sound from the hearing aid receiver to the external ear canal. The deflector tip is made up of a bridge 15 with two radially directed acoustic ports continuous with the cavity 51.

In the embodiment shown by FIGS. 2A-2F, the earbud further comprises a barrier wall 25 at the proximal end of the body and the body has one or more radially directed acoustic ports 52 continuous with the cavity 51 for conducting sound from the hearing aid receiver to the external ear canal. In one embodiment, the body has three such radially directed acoustic ports are 120 degrees apart. The one or more radially directed acoustic ports may be located adjacent to the barrier wall. The circumference of the retainer ring 30 may be made smaller than the circumference of the proximal end of the body so that the retainer ring 30 is blocked from advancing distally beyond the proximal end of the body when the earbud is inserted into the external ear canal.

Figure 3:
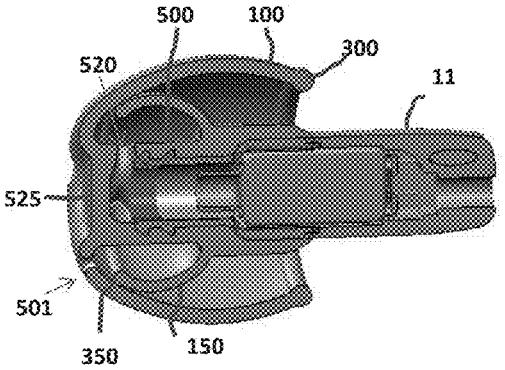
FIG. 3 illustrates an earbud according to one embodiment.

FIG. 3 illustrates another embodiment of an earbud with dual flanges. In this embodiment, a cylindrically shaped body 500 has proximal and distal ends and a cavity located at its distal end for receiving and connecting to a hearing aid's receiver 11. A barrier wall 525 is located at the proximal end of the body, and the body 500 has one or more radially directed first acoustic ports 520 adjacent to the barrier wall and continuous with the body cavity for conducting sound from the hearing aid receiver. A first flange 150 made of resilient material extends radially and longitudinally from the circumference of a portion of the body and terminates in a relatively more rigid first retainer ring 350. The circumference of the first flange 150 increases with longitudinal distance from the circumference of the body 500 up to a maximum value at an apex and then decreases to the circumference of the first retainer ring 350. The circumference of the first retainer ring 350 is greater than the circumference of the body and further wherein the first flange 150 is adapted to be extended toward the proximal end of the body. The earbud also includes a second flange 100 made of resilient material that extends radially and longitudinally from the circumference of the proximal end of body and terminates in a relatively more rigid second retainer ring 300. The circumference of the second flange 100 increases with longitudinal distance from the proximal end of the body up to a maximum value and then decreases to the circumference of the second retainer ring 300. The circumference of the second retainer ring 300 is greater than the circumference of the body 500, and the second flange 100 is adapted to be inverted and extended distally to cover the first flange 150. One or more second acoustic ports 501 are located in the second flange 100 for conducting sound from the first acoustic ports 520 to the external ear canal. The one or more acoustic ports 501 in the second flange 100 may be located adjacent to the body 500. The second flange 100 may be inverted to contact the first retainer ring 350.

The embodiments described above possess numerous functional advantages over previous earbuds. A larger wax reservoir is provided, and a torturous path for wax ingress is created that is impossible to create with conventional part designs. A controlled acoustic path is also provided. The molded design allows torturous paths to be designed into the bud that are not possible without the inverted flange concept. The inverted flange eliminates the need to consider a trapped steel condition in the tooling as a limitation of design. Without this flange, only a 2-piece assembly could achieve as efficient a design. The flange extends over the multiple acoustic ports in the earbud to create a protective wall that separates the ports from the canal wall during insertion and removal to reducing the scooping action that can contribute to blockages. The redundancy in acoustic ports ensures that even with one blocked or clogged, the remaining ports are sufficient to provide an effective acoustic path for the receiver.

In one embodiment, the earbud as described above is constructed from a single-shot molding process where the material thicknesses of the body, flange, and/or retainer ring are made different so as to result in different degrees of resilience or stiffness between those components. In another embodiment, a two-shot or multiple shot molding process may be used so that the body is made of a stiffer material than the flange. Using a stiffer material for the body, for example, allows it to be constructed with a thinner wall section. Also, the retainer ring could be two-shot molded or pre-molded using a different material from the flange and/or body to ensure that the retainer ring does not slip over the body during insertion of the earbud into the external ear canal.

Figure 4:
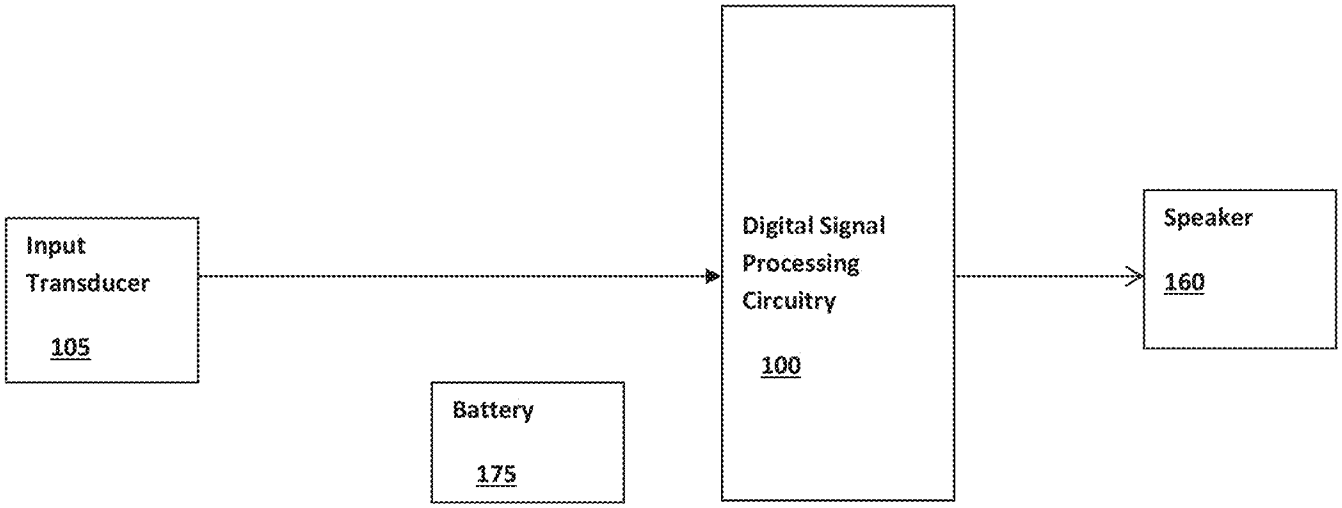
FIG. 4 shows the basic electronic components of an example hearing aid.

FIG. 4 illustrates the basic functional components of an example hearing aid. Hearing aids are devices that compensate for hearing losses by amplifying sound whose electronic components include a microphone for receiving ambient sound, an amplifier for amplifying the microphone signal in a manner that depends upon the frequency and amplitude of the microphone signal, a speaker for converting the amplified microphone signal to sound for the wearer, and a battery for powering the components. The electronic circuitry of the hearing aid is contained within a housing that may be placed, for example, in the external ear canal or behind the ear. An input transducer (i.e., microphone) 105 receives sound waves from the environment and converts the sound into an input signal. After amplification by a pre-amplifier, the input signal is sampled and digitized to result in a digitized input signal that is passed to digital signal processing (DSP) circuitry 100. The DSP circuitry processes the digitized input signal into an output signal in a manner that compensates for the patient's hearing deficit (e.g., frequency-specific amplification and compression). The output signal is then converted to analog form and passed to an audio amplifier that drives a receiver 160 (a.k.a. a loudspeaker) to convert the output signal into an audio output. A battery 175 supplies power for the electronic components. In an RIC hearing aid, the receiver 160 may be attached to an earbud such as described above that is placed in the external ear canal, while the rest of the hearing aid components are housed in a main body that is usually placed behind ear. In other types of hearing aids, the receiver 160 may be housed in the main body with sound conducted to the earbud via an audio tube.

Example Embodiments

In an example embodiment, a hearing aid comprises: an input transducer for converting an audio input into an input signal; a digital signal processor (DSP) for processing the input signal into an output signal in a manner that compensates for a patient's hearing deficit; an audio amplifier and receiver for converting the output signal into an audio output; and an earbud as described above attached to the receiver.

In another embodiment, a method for constructing an earbud for insertion into an external ear canal, comprises: molding a cylindrically shaped body with proximal and distal ends and having a resilient flange extending radially and longitudinally from the circumference of portion of the body and terminating in a relatively more rigid retainer ring, wherein the circumference of the flange increases with longitudinal distance from the distal end of the body up to a maximum value at an apex and then decreases to the circumference of the retainer ring; disposing a cavity in the body located at its distal end for receiving and connecting to a hearing aid's receiver; inverting the flange is so that the retaining ring is located proximally from the proximal end of the body to form a debris reservoir between the flange and the body for collecting wax as the earbud is inserted into the external ear canal; and, disposing one or more acoustic ports located at the proximal end of the body for conducting sound produced by the hearing aid receiver into the external ear canal.

Hearing assistance devices typically include an enclosure or housing, a microphone, hearing assistance device electronics including processing electronics, and a speaker or receiver. It is understood that in various embodiments the microphone is optional. It is understood that in various embodiments the receiver is optional. Such devices may include antenna configurations, which may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the wearer.

It is understood that digital hearing aids include a processor. In digital hearing aids with a processor programmed to provide corrections to hearing impairments, programmable gains are employed to tailor the hearing aid output to a wearer's particular hearing impairment. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. An earbud for insertion into an external ear canal, comprising:

a cylindrically shaped body having proximal and distal ends and having a cavity located at its distal end for receiving and connecting to a hearing aid's receiver;

a flange made of resilient material extending radially and longitudinally from the circumference of a portion of the body and terminating in a relatively more rigid retainer ring, wherein the circumference of the flange increases with longitudinal distance from the distal end of the body up to a maximum value at an apex and then decreases to the circumference of the retainer ring;

wherein the flange is adapted to be inverted so that the retaining ring is located proximally from the proximal end of the body to form a debris reservoir between the flange and the body for collecting wax as the earbud is inserted into the external ear canal;

wherein the circumference of the retainer ring is smaller than the circumference of the proximal end of the body so that the retainer ring is blocked from advancing distally beyond the proximal end of the body when the earbud is inserted into the external ear canal; and, one or more acoustic ports located at the proximal end of the body for conducting sound produced by the hearing aid receiver into the external ear canal.

2. The earbud of claim 1 wherein the flange extends from the circumference at the distal end of the body.

3. The earbud of claim 1 wherein the circumference of the retainer ring is smaller than the circumference of the body but is stretchable to allow the flange to be inverted over the body.

4. The earbud of claim 1 further comprising a barrier wall at the proximal end of the body and wherein the body has one or more radially directed acoustic ports for conducting sound from the hearing aid receiver to the external ear canal.

5. The earbud of claim 4 wherein the body has three radially directed acoustic ports are 120 degrees apart.

6. The earbud of claim 4 wherein the one or more radially directed acoustic ports are located adjacent to the barrier wall.

7. The earbud of claim 1 further comprising a deflector tip at the proximal end of the body having two radially directed acoustic ports for conducting sound from the hearing aid receiver to the external ear canal.

8. An earbud for insertion into an external ear canal, comprising:

a cylindrically shaped body having proximal and distal ends and having a cavity located at its distal end for receiving and connecting to a hearing aid's receiver;

a barrier wall at the proximal end of the body and wherein the body has one or more radially directed first acoustic ports adjacent to the barrier wall for conducting sound from the hearing aid receiver;

a first flange made of resilient material extending radially and longitudinally from the circumference of a portion of the body and terminating in a relatively more rigid first retainer ring, wherein the circumference of the first flange increases with longitudinal distance from the circumference of the body up to a maximum value and then decreases to the circumference of the first retainer ring;

wherein the circumference of the first retainer ring is greater than the circumference of the body and further wherein the first flange is adapted to be extended toward the proximal end of the body;

a second flange made of resilient material extending radially and longitudinally from the circumference of the proximal end of body and terminating in a relatively more rigid second retainer ring, wherein the circumference of the second flange increases with longitudinal distance from the proximal end of the body up to a maximum value and then decreases to the circumference of the second retainer ring;

wherein the circumference of the second retainer ring is greater than the circumference of the body and wherein the second flange is adapted to be inverted and extended distally to cover the first flange; and, one or more second acoustic ports in the second flange for conducting sound from the first acoustic ports to the external ear canal.

9. The earbud of claim 8 wherein the one or more acoustic ports in the second flange are located adjacent to the body.

10. The earbud of claim 8 wherein the second flange is inverted to contact the first retainer ring.

11. A method for constructing an earbud for insertion into an external ear canal, comprising:

molding a cylindrically shaped body with proximal and distal ends and having a resilient flange extending radially and longitudinally from the circumference of portion of the body and terminating in a relatively more rigid retainer ring, wherein the circumference of the flange increases with longitudinal distance from the distal end of the body up to a maximum value and then decreases to the circumference of the retainer ring;

disposing a cavity in the body located at its distal end for receiving and connecting to a hearing aid's receiver;

inverting the flange so that the retaining ring is located proximally from the proximal end of the body to form a debris reservoir between the flange and the body for collecting wax as the earbud is inserted into the external ear canal; wherein the circumference of the retainer ring is smaller than the circumference of the proximal end of the body so that the retainer ring is blocked from advancing distally beyond the proximal end of the body when the earbud is inserted into the external ear canal; and, disposing one or more acoustic ports located at the proximal end of the body for conducting sound produced by the hearing aid receiver into the external ear canal.

12. The method of claim 11 wherein the circumference of the retainer ring is smaller than the circumference of the body and stretching the ring to invert the flange over the body.

13. The method of claim 11 further comprising forming a barrier wall at the proximal end of the body and disposing one or more radially directed acoustic ports in the circumference of the body for conducting sound from the hearing aid receiver to the external ear canal.

14. The method of claim 13 wherein the body has three radially directed acoustic ports are 120 degrees apart.

15. The method of claim 13 wherein the one or more radially directed acoustic ports are located adjacent to the barrier wall.

16. The method of claim 11 further comprising disposing a deflector tip at the proximal end of the body having two radially directed acoustic ports for conducting sound from the hearing aid receiver to the external ear canal.

17. The method of claim 11 wherein the molding is carried out using a single-shot molding process.

18. The method of claim 11 wherein the molding is carried out using a double-shot molding process with the flange and body made of different materials.

* * * * *